US010561209B1

(12) United States Patent
Huynh

(10) Patent No.: US 10,561,209 B1
(45) Date of Patent: Feb. 18, 2020

(54) RING WITH MAGNETIZED INSERT

(71) Applicant: Chi Huynh, San Dimas, CA (US)

(72) Inventor: Chi Huynh, San Dimas, CA (US)

( * ) Notice: Subject to any disclaimer, the term of this patent is extended or adjusted under 35 U.S.C. 154(b) by 0 days.

(21) Appl. No.: 16/192,615

(22) Filed: Nov. 15, 2018

Related U.S. Application Data

(60) Provisional application No. 62/737,725, filed on Sep. 27, 2018.

(51) Int. Cl.
*A44C 9/00* (2006.01)
*A44C 27/00* (2006.01)
*A44C 15/00* (2006.01)

(52) U.S. Cl.
CPC ..... *A44C 9/0061* (2013.01); *A44C 15/003* (2013.01); *A44C 27/002* (2013.01)

(58) Field of Classification Search
CPC ..... A44C 9/00; A44C 9/0061; A44C 9/0053; A45F 2200/0516; A45F 2005/002
USPC ..... 63/1.12, 15; 248/683; 224/217
See application file for complete search history.

(56) References Cited

U.S. PATENT DOCUMENTS

| | | | |
|---|---|---|---|
| 715,795 | A | 12/1902 | Haskell |
| D203,551 | S | 1/1966 | Tranfield |
| 4,052,864 | A | 10/1977 | Hofsaess |
| 4,905,335 | A | 3/1990 | Tervola |
| 4,912,944 | A | 4/1990 | Crosley et al. |
| 5,197,168 | A | 3/1993 | Levy |
| D342,916 | S | 1/1994 | Giralt |
| D392,585 | S | 3/1998 | Kohl |
| 5,921,110 | A | 7/1999 | Middendorff et al. |
| 5,989,178 | A | 11/1999 | Chiu |
| 6,101,843 | A | 8/2000 | Nagano |
| D440,180 | S | 4/2001 | Giesen |
| D442,509 | S | 5/2001 | Yamanaka |
| D444,094 | S | 6/2001 | Boehm |
| 6,497,117 | B2 | 12/2002 | Ofiesh, II |
| 6,532,765 | B1 | 3/2003 | Hurwitz |
| 6,594,871 | B2 | 7/2003 | Hoffman |
| D480,981 | S | 10/2003 | Pasquetti |
| 6,715,315 | B1 | 4/2004 | Hartgrove |
| D495,616 | S | 9/2004 | Fountoulakis |
| 6,851,279 | B2 | 2/2005 | Hartgrove |
| 6,962,063 | B1 | 11/2005 | Pearl |
| 7,013,674 | B2 | 3/2006 | Kretchmer |
| 7,143,607 | B2 | 12/2006 | Hartgrove |
| 7,201,021 | B2 | 4/2007 | Hartgrove |

(Continued)

FOREIGN PATENT DOCUMENTS

| | | | |
|---|---|---|---|
| DE | 29913811 | U1 | 10/1999 |
| WO | WO-2018096843 | A1 * | 5/2018 |

OTHER PUBLICATIONS

DE29913811 U1 Machine Translation.

*Primary Examiner* — Jack W Lavinder
(74) *Attorney, Agent, or Firm* — Wagenknecht IP Law Group PC

(57) ABSTRACT

An article of jewelry in the form of a magnetic ring, which includes a substantially circular shank having an upper half and a lower half, where the lower half has a non-magnetizable region of non-magnetizable material; and a magnetized insert embedded within the non-magnetizable region of the lower half of the shank, where the insert is configured to induce a magnetic field beneath the ring, the insert having a magnet joined to a magnetized substrate, which follows a contour of the shank.

8 Claims, 7 Drawing Sheets

(56) References Cited

U.S. PATENT DOCUMENTS

| | | | | |
|---|---|---|---|---|
| 7,216,508 | B2 | 5/2007 | Kretchmer et al. | |
| D601,054 | S | 9/2009 | Sivriere | |
| D626,025 | S | 10/2010 | Iacomucci | |
| 8,113,013 | B2 | 2/2012 | Kessler | |
| D668,985 | S | 10/2012 | Huynh | |
| 8,375,586 | B2 | 2/2013 | Huynh | |
| 8,490,429 | B2 | 7/2013 | Huynh | |
| 8,887,970 | B2 * | 11/2014 | Tsai | G06F 1/1626 224/217 |
| 2005/0039488 | A1 | 2/2005 | Dunmire | |
| 2006/0174649 | A1 | 8/2006 | Azrielant | |
| 2007/0084241 | A1 | 4/2007 | Kretchmer et al. | |
| 2007/0095101 | A1 | 5/2007 | Pons | |

* cited by examiner

RING WITH MAGNETIZED INSERT

CROSS REFERENCE TO RELATED APPLICATIONS

This application claims benefit of priority to U.S. provisional patent application No. 62/737,725 filed Sep. 27, 2018, entitled, "Jewelry-ring with magnet for mobile phone support"; which is herein incorporated by reference in its entirety.

TECHNICAL FIELD

The invention relates generally to jewelry and more specifically to a ring having a magnetized insert that when worn around the finger magnetically attracts objects to the wearer's palm.

BACKGROUND OF THE INVENTION

Effectively grasping objects can be difficult when suffering from a condition that affects one's hands, such as arthritis or carpal tunnel syndrome. Likewise, with the miniaturization of electronics, devices such as mobile phones are becoming increasingly difficult to grasp over long periods of time due to their awkward dimensions. Although carrying cases and carrying handles are available as accessories for some objects, such accessories are often more adapted for transportation rather than for handling during use. For example, a pouch that clips to the belt may be suitable for carrying a mobile phone, but the phone must be removed from the belt prior to use, rendering it essentially useless during calls.

U.S. Pat. No. 8,560,031 provides a portable media case with extendable sockets for use with media players, such as mobile phones. Handling the phone typically involves wedging fingers between the sockets. However, the case significantly increases the footprint of the phone, which may not be desirable. In addition, positioning one or a few fingers between the sockets requires the remaining fingers to be spread outward, which may be uncomfortable over time.

Magnetism is a well-known principle that involves a force of attraction or repulsion at a distance due to the presence of a magnetic field. To this end, magnetic attraction has been used in the jewelry industry to assist with approaches for interchanging ornamentation. For example, U.S. Pat. No. 4,912,944 provides an article of jewelry with a base element having an outer surface configured for magnetic attraction with interchangeable ornamental substrates by way of a flexible magnet. However, such use is limited to ornamentation purposes for outward presentation and does not assist with handling larger devices during use over long periods of time.

SUMMARY OF THE INVENTION

The above challenges are solved by way of an article of jewelry in the form of a ring with a magnetized insert that directs a magnetic field beneath the ring. The ring includes a substantially circular shank having an upper half and a lower half, where the lower half has a non-magnetizable region. A magnetized insert is embedded within the non-magnetizable region of the lower half of the shank. The insert is configured to induce a magnetic field beneath the ring so that the underside of the ring is magnetically attracted to other suitable objects.

Non-magnetizable material is used in the lower half of the shank to direct attraction of objects to the region of the magnetized insert along the underside of the ring. In preferred embodiments, the upper half of the shank is also formed from a same non-magnetizable material. Among the non-magnetizable materials that can be used include precious metals such as gold and silver. Other non-magnetizable metals that can be used include aluminum, copper, tin, titanium, zinc, and alloys such as brass and bronze. Non-metals such as plastic, silicon, and rubbers can also be used as non-magnetizable material.

The shank is at least partially bored to form a recess or can be fully bored to form a through bore. The recess or through bore preferably provides an aperture exposing a portion of the insert through the bottom of the ring, thereby further directing magnetic forces beneath the ring. In some embodiments, the shank is bored to form a two-step aperture, where the upper step has a larger diameter than the lower step.

The magnetized insert is preferably formed by joining a magnet to a magnetizable substrate. Examples of magnetizable materials for use as the substrate include iron, nickel and magnetizable alloys. In some embodiments the embedded magnet is exposed through the bottom of the ring, and in other embodiments the embedded magnetizable substrate, which is now magnetized, is exposed through the bottom of the ring.

The magnet is preferably a neodymium magnet. Exemplary neodymium magnets that can be used include those graded as N42, N48, N50, or N52.

In some embodiments, the insert is capped along its top side with a cap. The cap can be magnetizable but is more preferably non-magnetizable and most preferably is made from a same material as the surrounding shank, such as gold or silver. Preferably, the cap follows the inner contour of the shank to match its curvature, which avoids scratching or discomfort.

In a related aspect, a method of forming the article of jewelry is provided, which includes forming a substantially circular shank from a non-magnetizable material; forming a through bore entirely through the shank and forming a magnetized insert shaped complementary to the through bore; embedding the insert within the aperture; and securing the insert to the shank.

DETAILED DESCRIPTION OF PREFERRED EMBODIMENTS

For clarity of disclosure, and not by way of limitation, the invention is discussed according to different detailed embodiments; however, the skilled artisan would recognize that features of one embodiment can be combined with other embodiments and is therefore within the intended scope of the invention. Unless defined otherwise, all technical and scientific terms used have the same meaning as is commonly understood by one of ordinary skill in the art to which this invention belongs. If a definition set forth in this document is contrary to or otherwise inconsistent with a well-accepted definition set forth in the art, the definition set forth in this document prevails over a contradictory definition.

Figure 1:
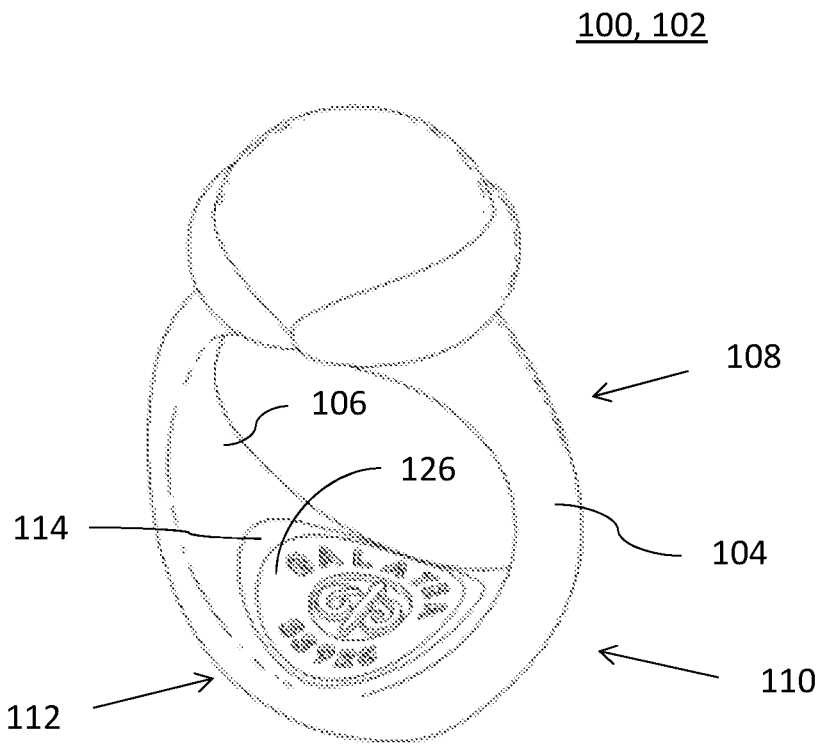
FIG. 1 is perspective view of a ring 102 showing cap 126 following an inner contour 106 of the shank 104 to match its curvature.

Beginning at FIG. 1, an article of jewelry 100 is provided in the form of a ring 102 that magnetically attracts objects to a region beneath the ring 102. Consistent with the jewelry arts, the ring 102 includes a substantially circular shank 104, which can be provided in various ring sizes for placement around an individual's finger. By "substantially circular" it is meant that the inside contour 106 of the shank 104 is circular or near circular consistent with the design of rings 102 in the jewelry industry. The artisan will appreciate that the outside of the shank 104 can be flat, convex or carved with ornamentation consistent with the jewelry arts.

For ease of reference, the ring 102 and corresponding shank 104 are described with reference to an upper half 108 and a lower half 110. The upper half 108 is that portion of the ring 102 or shank 104 intended to be positioned along the back of the finger or hand; whereas, the lower half 110 is that portion of the ring 102 or shank 104 that is positioned along the underside of the finger or the palm side of the hand. To this end, the upper half 108 is typically more ornate than the lower half 110; however, this is not a requirement.

Figure 2:
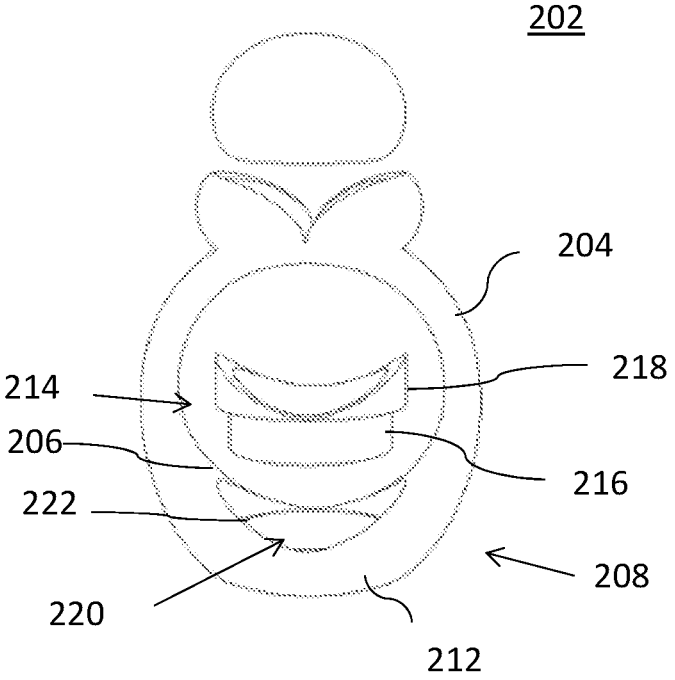
FIG. 2 is an exploded view of a ring 202 showing the complementary shape of the insert 214 and through bore 220, with the magnet 216 positioned underneath a magnetized substrate 218 that is shaped to follow the inner contour 206 of the shank 204.

Turning to FIG. 2, the lower half 208 of the shank 204 has a non-magnetizable region 212, which directs magnetic attraction to the insert 214. Most preferably, the entire shank 204 is formed from a same non-magnetizable material so that the insert 214 is the sole source for magnetic interaction with foreign objects. The term "magnetizable material" as used herein refers to a composition that is susceptible to magnetization. For completeness, a "magnetizable substrate" becomes a "magnetized substrate" when joined to a magnet 216. Examples of magnetizable materials include iron, nickel, cobalt and some alloys of rare earth metals. In contrast, a "non-magnetizable material" as used herein refers to a composition that is not susceptible to magnetization or only slightly susceptible to magnetization, thereby avoiding interference with magnetic attraction between the insert 214 and the magnetic or magnetizable object intended for attraction. Among the non-magnetizable materials that can be used include precious metals such as gold and silver. Other non-magnetizable metals that can be used include aluminum, copper, tin, zinc, and alloys such as brass and bronze. Titanium is only slightly susceptible to magnetization and is therefore consider non-magnetizable within the present invention. Non-metals such as plastic, silicon, and rubbers can also be use as non-magnetizable material.

The non-magnetic region 212 of the lower half 210 of the shank 204 is bored to accept the magnetized insert 214. Shown more clearly in FIG. 3, a two-step through bore 320 is preferred, where the upper step 322 has a larger diameter than the lower step 324.

Figure 5:
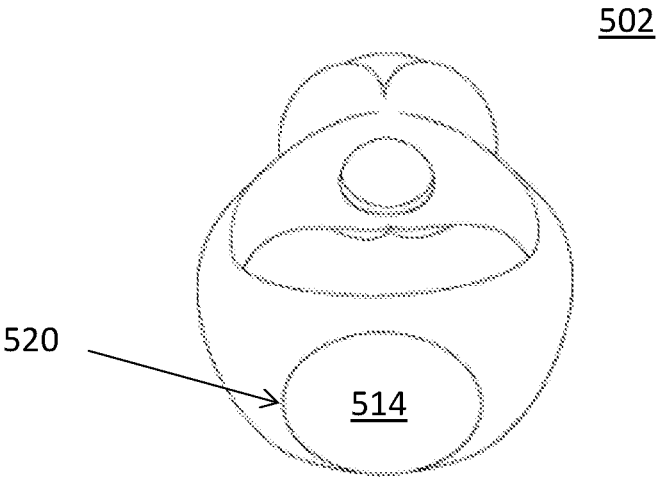
FIG. 5 is an isometric view showing an aperture 520 exposing an insert 514 along the bottom of the ring 502.
Figure 6:
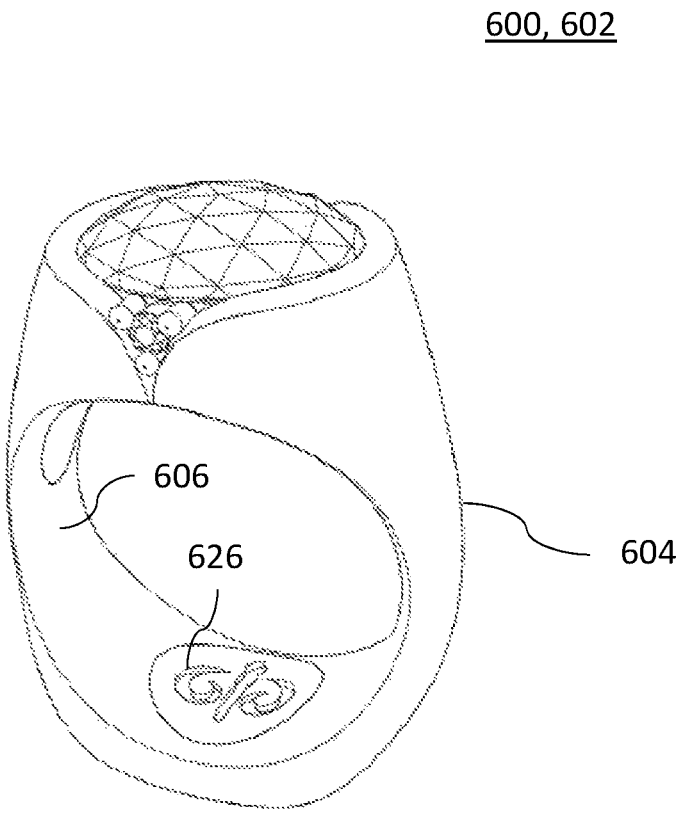
FIG. 6 is another embodiment of a ring 602 with cap 626 following the inner contour 606 of the shank 604.
Figure 7:
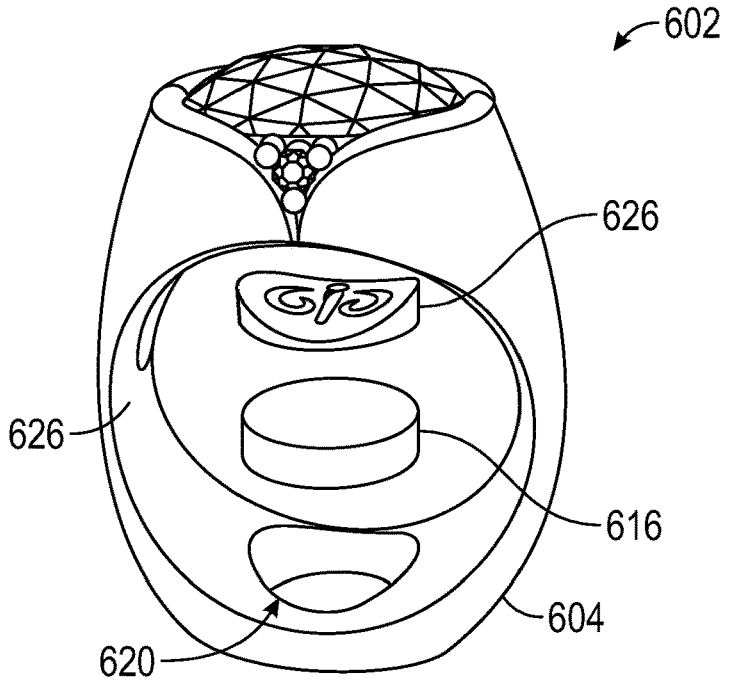
FIG. 7 is an exploded isometric view of a ring 602 showing the complementary shape of the magnet 616 and bored recess 620, with the cap 626 shaped to follow the inner contour 606 of the shank 604.

Turning back to FIG. 2, in some embodiments the magnetized insert 214 includes a magnet 216 joined underneath a magnetized substrate 218 so that the magnetized substrate 218 rests against the first step 222 of the aperture 220. In this configuration, the magnet 216 is preferably exposed through the bottom of the ring 202 via an aperture 520 (See FIG. 5) for direct magnetic attachment to a desired object, while the magnetized substrate 218 (here formed from iron) positioned above the magnet 216 expands the spread of the magnetic forces for initial attraction, provides an additional supporting surface to rest against the two-step aperture 220, and provides a surface for sculpting so that the insert 214 follows the inner contour 206 of the shank 204. Furthermore, by providing the magnetized substrate 206 above the magnet 216, the insert 214 can be welded or fused to the shank 204 along the inner contour 206 of the ring 204 without adversely affecting the magnet 216.

It has been found that by joining a magnet 216 to a magnetizable substrate 206, the size of the source magnet 216 can be reduced while its effective magnetic span can be increased. This is desired when attempting to magnetically hold a large object with merely a shank 204 of a ring 202. On the one hand strong magnetic attraction is desired to firmly hold objects such as mobile phones. On the other hand, it also desirable to reduce the size of the magnet 216 because a large magnet 216 would require substantial sculpting to follow the contour of a ring 202. Magnets 216 can be challenging to sculpt to follow an arc. By providing a magnetizable material that can be cut, cast or bent, the effective span of the magnet 216 can follow an arc associated with a ring 202, while also permitting the size of the magnet 216 to be reduced.

Figure 3:
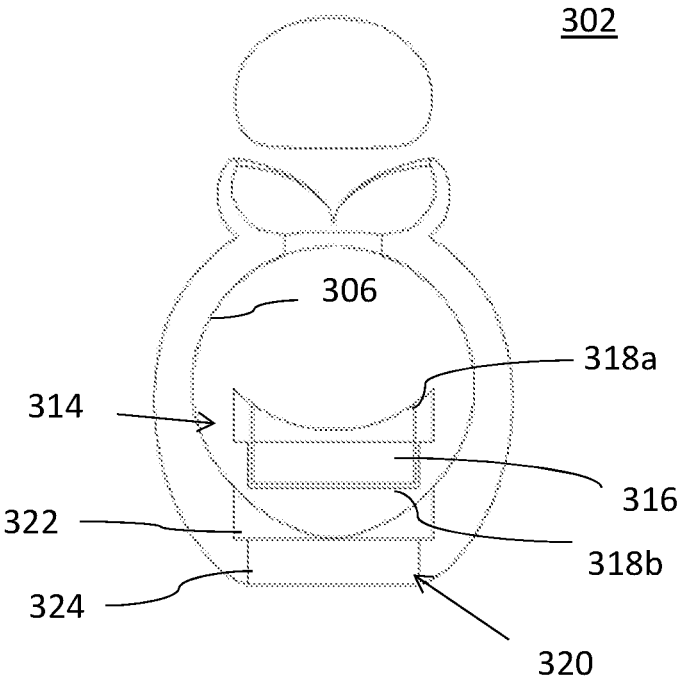
FIG. 3 is an exploded front cutaway view of a ring 302 showing the complementary shape of the insert 314 following the contour of the through bore 320. Also shown is a magnet 316 positioned within a magnetized upper layer substrate 318*a* and magnetized lower layer substrate 318*b*.

Proceeding to FIG. 3, an alternative magnetized insert 314 is characterized as magnetized substrates 318*a*, 318*b* joined above and below the magnet 316. Joining the magnet 316 to the magnetized substrate 318*a*, 318*b* can be by magnet attraction; however, if also glued with an adhesive, the insert 314 can be formed more securely. In this configuration, the magnet 316 is wrapped so that lower magnetized substrate 318*b* is exposed through the bottom of the ring 302 via an aperture 520 (See FIG. 5) for direct magnetic attachment to a desired object, while the upper magnetized substrate 318*a* (here formed from iron) positioned above the magnet 314 expands the spread of magnetic forces for initial attraction, provides an additional supporting surface to rest against the two-step aperture 320, and provides a surface for sculpting so that the insert 314 follows the inner contour 306 of the shank 304. In this embodiment, the magnet 316 itself is protected against direct interaction to avoid potential scraping or gouging of the magnet 316. A magnetizable material such as iron is more resistant to surface gouging. Furthermore, by providing the magnetized substrate 318*a* above the magnet 316, the insert 314 can be welded or fused to the shank 304 along the inner contour 306 of the ring 302 without adversely affecting the magnet 316.

Figure 4:
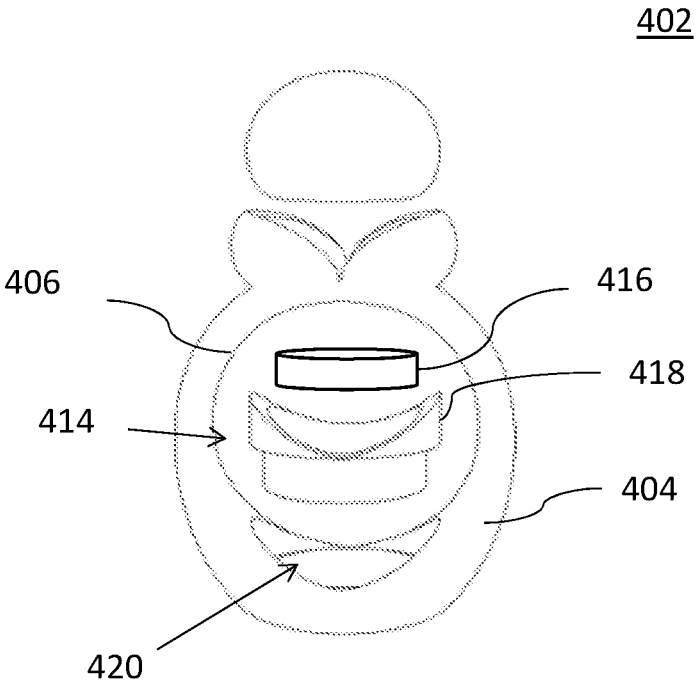
FIG. 4 is an exploded isometric view of a ring 402 showing the complementary shape of the insert 414 and through bore 420, with the magnet 416 configured for insertion into a housing/substrate 418 formed from a magnetizable material.

In the embodiment depicted in FIG. 4, the magnetized substrate 418 forms an outer capsule for housing the magnet 416. In this configuration, the magnet 416 is encapsulated within the magnetized substrate 418 so that the magnetized substrate 418 is exposed through the bottom of the ring 402 via an aperture 520 (See FIG. 5) for direct magnetic attachment to a desired object and expands the spreading of the magnetic forces for attraction. In addition, the magnetized substrate 418 provides an additional supporting surface to rest against the two-step aperture 420 and provides a surface for sculpting so that the insert 414 follows the inner contour 406 of the shank 404. In this embodiment, the magnet 416 itself is protected against direct interaction to avoid potential scraping or gouging of the magnet 416. A magnetizable material such as iron is more resistant to surface gouging. Furthermore, by providing the magnetized substrate 418 above the magnet 416, the insert 414 can be welded or fused to the shank 404 along the inner contour 406 of the ring 402 without adversely affecting the magnet 416.

In each of the embodiments herein, the magnetized substrate 118, 218, 318*a*, 318*b*, 418 (generally prior to magnetization) can be shaped using any suitable process, such as hot or cold stamping, or by pouring a hot melt (e.g. molten iron) into a suitably shaped mold. Furthermore, after forming the insert 114, 214, 314, 414, the insert 214, 314, 414 can be glued to the shank 104, 204, 304, 404 or can be welded or fused to the shank 104, 204, 304, 404 along the inner contour 106, 206, 306, 406 of the ring 102, 202, 302, 402. Returning to FIG. 1, a cap 126 can then be placed along the inner contour 106 of the shank 104 to at least partially cover the insert 114. In preferred embodiments, the cap 104 is formed from a same non-magnetizable material as the lower half 110 of the shank 104, such as gold.

FIGS. 6-9 depict another exemplary article of jewelry 600 in the form of a ring 602, which includes a substantially circular shank 604 having a recess 620 at a lower end 610, a magnet 616 embedded within the recess 620, and a cap 626 that caps the recess 620 and that follows the inner contour 606 of the shank 604.

Preferably, the entire shank 604 is formed from a same non-magnetizable material. Among the non-magnetizable materials that can be used include precious metals such as gold and silver. Other non-magnetizable metals that can be used include aluminum, copper, tin, zinc, and alloys such as brass and bronze. Titanium is only slightly susceptible to magnetization and is therefore consider non-magnetizable. Non-metals such as plastic, silicon, and rubbers can also be use as non-magnetizable material.

Figure 8:
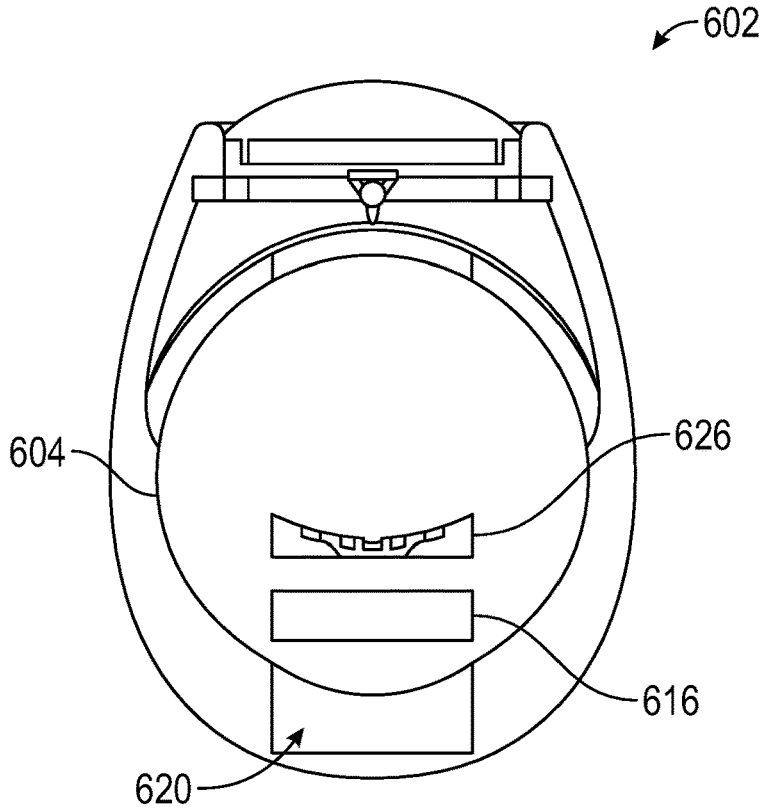
FIG. 8 is an exploded front cutaway view of a ring 602 showing the complementary shape of the magnet 616, cap 626 and bored recess 620.
Figure 9:
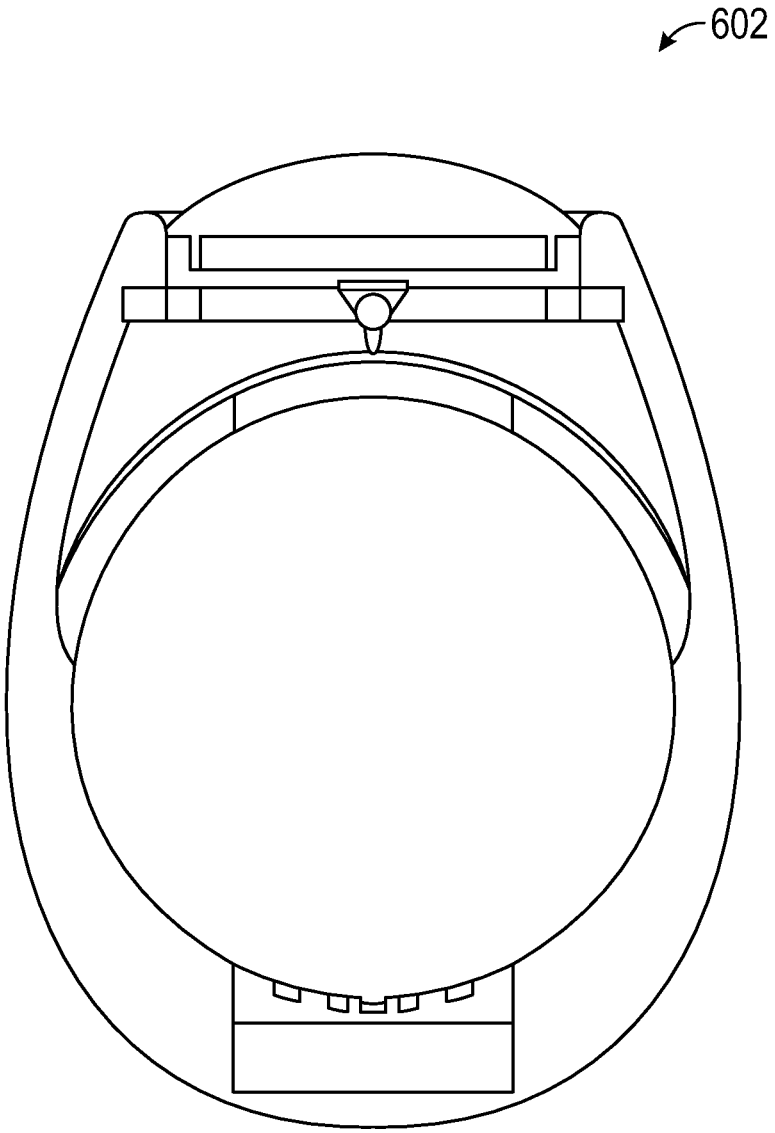
FIG. 9 is a front cutaway view of the ring 602 of FIG. 6.

Shown more clearly in FIG. 8, the shank 604 is partially bored to form a recess 620 suitable for accepting the magnet 616. In other embodiments, the shank 604 has a through bore to expose the magnet 616 underneath the ring 602. After insertion of the magnet 602 into the recess 620, a cap 626, which is shaped to follow the inner contour 606 of the inner shank 604, is placed over the magnet 616. In preferred embodiments, the cap 626 is formed from a same non-magnetizable material as the shank 604, such as gold.

Figure 10:
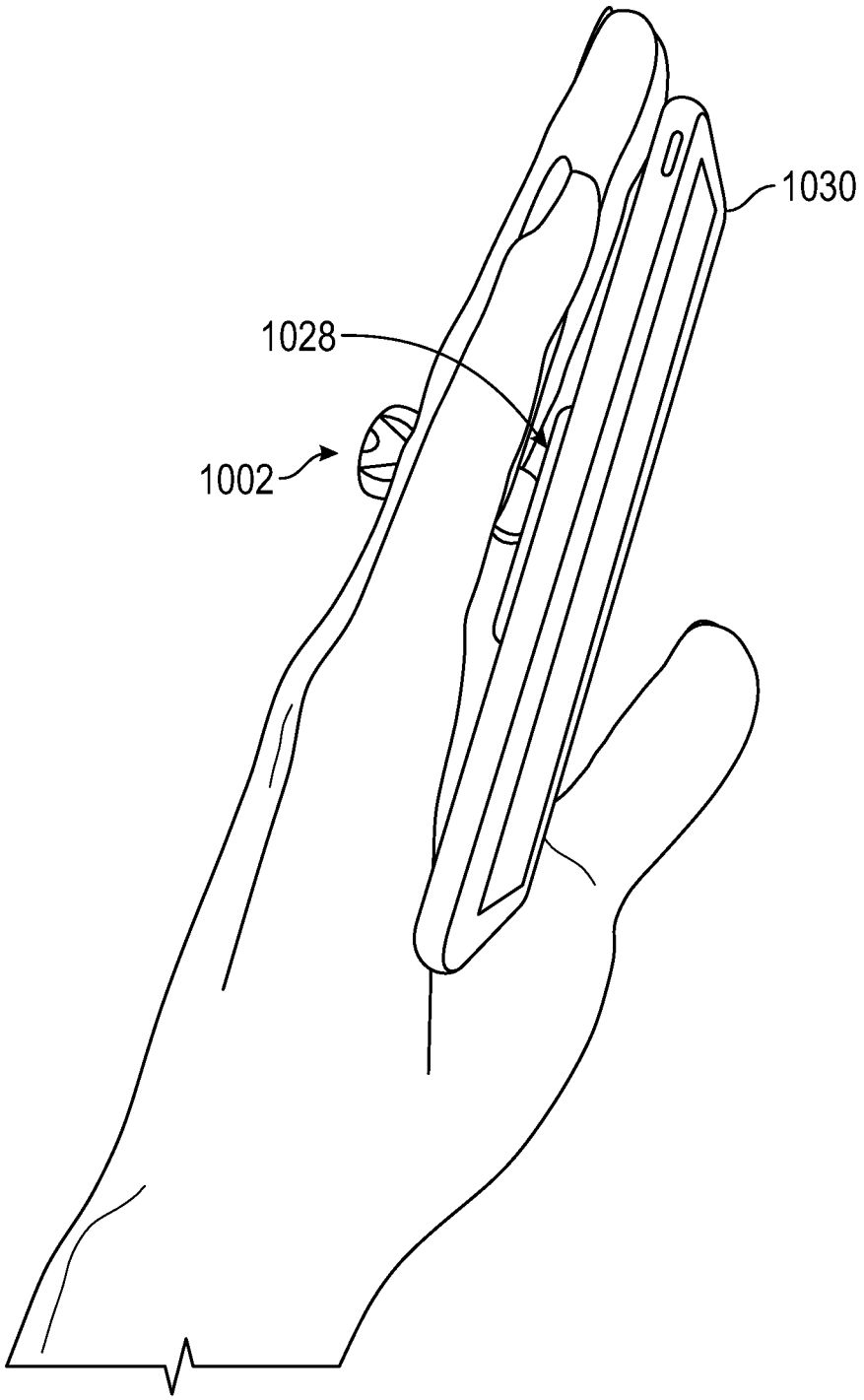
FIG. 10 depicts an exemplary use of a ring 1002 magnetically interacting with an adhesive strip 1028 applied to and to assist with holding a mobile phone 1030.

The above described devices can be used to attract a variety of objects that are magnetizable. For example, FIG. 10 shows an exemplary use of a ring 1002 having a magnetic insert. In particular, a magnetizable or magnetic strip 1028 of opposite polarity can be applied to a cell phone 1030. A user, wearing the ring 1002 with embedded magnetized insert can magnetically join the underside of the ring 1002 to the strip 1028, thereby magnetically holding the cell phone 1030 in the user's hands. Preferably, the ring 1002 and strip 1028 are sufficiently attracted so that the user is not required to grasp the phone 1030 and permits rotation and movement of the phone 1030 along the palm to a variety of comfortable positions. Experimentally it has been found that neodymium magnets having a grade of N42 and N52 in connection with strips 1028 of opposite polarity worked best. However, neodymium magnets having a grade of N48 and N50 are also expected to work well.

What is claimed is:

1. An article of jewelry in the form of a magnetic ring, the ring comprising:

a substantially circular shank comprising an upper half and a lower half, wherein the lower half comprises a non-magnetizable region of non-magnetizable material; and a magnetized insert embedded within the non-magnetizable region of the lower half of the shank, wherein the insert is configured to induce a magnetic field beneath the ring, the insert comprising a magnet joined to a magnetized substrate, wherein the insert follows a contour of the shank, wherein the shank comprises an aperture exposing a portion of the insert through the bottom of the ring and the magnetized substrate is exposed through the bottom of the ring.

2. The article of jewelry of claim 1, wherein the non-magnetizable material is selected from the group consisting of a plastic, gold, and silver.

3. The article of jewelry of claim 1, wherein the aperture comprises two steps, wherein an upper step comprises a larger diameter than a lower step.

4. The article of jewelry of claim 1, wherein the magnet is a neodymium magnet.

5. The article of jewelry of claim 4, wherein the neodymium magnet comprises a grade selected from the group consisting of N42, N48, N50, and N52.

6. The article of jewelry of claim 1, wherein the insert is capped along its top side with a non-magnetizable cap that follows an inner contour of the shank.

7. The article of jewelry of claim 1, wherein the top half comprises a precious or semi-precious gemstone ornamentation.

8. A method of forming the article of jewelry of claim 1, the method comprising:

a) forming a substantially cylindrical shank from a non-magnetizable material;

b) forming a through bore entirely through the shank and an insert shaped complementary to the through bore;

c) embedding the insert within the through bore; and d) securing the insert to the shank.

* * * * *